US006489072B2

(12) United States Patent
Sasaki et al.

(10) Patent No.: US 6,489,072 B2
(45) Date of Patent: Dec. 3, 2002

(54) ELECTROPHOTOGRAPHIC PHOTOCONDUCTOR AND METHOD FOR MANUFACTURING SAME

(75) Inventors: Teruo Sasaki, Nagano (JP); Yoichi Nakamura, Nagano (JP); Shinjirou Suzuki, Nagano (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 0 days.

(21) Appl. No.: 09/871,593

(22) Filed: May 31, 2001

(65) Prior Publication Data

US 2002/0034699 A1 Mar. 21, 2002

(30) Foreign Application Priority Data

May 31, 2000 (JP) ..... 2000-163320
Dec. 4, 2000 (JP) ..... 2000-368877

(51) Int. Cl.[7] ..... G03G 5/06
(52) U.S. Cl. ..... 430/59.5; 430/78; 430/134
(58) Field of Search ..... 430/59.5, 78, 134

(56) References Cited

U.S. PATENT DOCUMENTS 5,153,313 A * 10/1992 Kazmaier et al. ..... 430/76
5,418,107 A * 5/1995 Nealey et al. ..... 430/78

FOREIGN PATENT DOCUMENTS

| | | |
|---|---|---|
| JP | 60243089 | 3/1985 |
| JP | 02170166 | 6/1990 |
| JP | 0335245 A | 2/1991 |
| JP | 07207183 | 8/1995 |

* cited by examiner

*Primary Examiner*—John Goodrow
(74) *Attorney, Agent, or Firm*—Darby & Darby

(57) ABSTRACT

An electrophotographic photoconductor includes a conductive substrate and a photosensitive layer formed on a substrate. The photosensitive layer includes a phthalocyanine compound as a charge generation substance. An embodiment of the photosensitive layer contains a first phthalocyanine compound as a main component and a second phthalocyanine compound as a secondary component and as a result, has greater ability to generate negative charges than the ability of the first phthalocyanine compound.

8 Claims, 3 Drawing Sheets

ELECTROPHOTOGRAPHIC PHOTOCONDUCTOR AND METHOD FOR MANUFACTURING SAME

BACKGROUND OF THE INVENTION

1. Field of the Invention

The present invention relates to an electrophotographic photoconductor (also referred to as "a photoconductor") used in a printer, a copier, or a facsimile machine that employs an electrophotographic process. In particular, the invention relates to a photoconductor that comprises an improved photosensitive material in a photosensitive layer, thereby exhibiting an excellent potential retention rate. The invention also relates to a method for manufacturing such a photoconductor.

2. Description of the Related Art

It is generally known that electrophotographic photoconductors provide the function of maintaining surface charges in the dark, generating charges upon receipt of light, and transporting charges upon receipt of light. Known types of photoconductors include single-layer type photoconductors having all of these functions in a single layer. Also know are laminated-layer type photoconductors consisting of function-separated two layers, where one layer mainly serves to generate charges and another layer serves to maintain surface charges in the dark and to transport charges upon receipt of light.

These types of photoconductors are used for forming images by known electrophotographic methods, such as the Carlson method. Image formation using this method includes the steps of charging the photoconductor by a corona discharge in the dark, forming an electrostatic latent image, such as characters or drawings of an original, on the charged surface of the photoconductor, developing the thus formed electrostatic image by means of toner powder, transferring and fixing the toner powder representing the image onto a support, such as paper.

After the toner transfer, the residual toner powder is removed, and residual charges are erased by light exposure, so that the photoconductor can be used again.

Various substances have been employed as photosensitive materials in electrophotographic photoconductors. For example, inorganic photoconductive substances include selenium, selenium alloys, zinc oxide and cadmium sulfide, dispersed in a resin binder, as well as organic photoconductive substances, such as poly-N-vinylcarbazole, poly(vinyl anthracene), phthalocyanine compound or bisazo compound, dispersed in a resin binder or subjected to vacuum deposition.

Among the organic photosensitive substances described above, the phthalocyanine compound exhibits quite different electrophotographic properties depending its crystal form. A variety of studies have investigated this substance.

Methods for applying the phthalocyanine compounds have been reported not only in cases where one type of that compound is used, but also in cases where two or more types of that compound are used as a mixture.

Uses of two or more types of phthalocyanine compounds by intentional mixing are disclosed in Japanese Unexamined Patent Application Publication (KOKAI) Nos. H2-170166, H2-84661, and H6-145550. Unfortunately, the mixed use of the phthalocyanines in these references was only aiming at a simple use of mixed crystals. No reference discloses a study on difference in positive or negative charge generating ability in a charge generation process of the mixed materials. Xabq The mixed use of two or more phthalocyanine compounds can be unintentionally conducted by generation of side products during the synthesis process of phthalocyanine. Japanese Unexamined Patent Application Publication (KOKAI) No. H3-35245, discloses discussions on side production of titanyloxo(chlorophthalocyanine) in the synthesis process of titanyloxophthalocyanine. This reference discloses that inclusion of 0.38 to 5 wt % of chlorine is confirmed in the patent documents published in the past. The reference further discloses a detailed study on a synthesis method of titanyloxophthalocyanine that does not generate a side product of chlorine-containing phthalocyanine.

According to the references, titanyloxophthalocyanine with high purity and without lattice defects may be obtained by suppressing generation of the side product of chlorine-containing phthalocyanine. As a result, photoconductors with excellent potential retention capability and high sensitivity may be generated. Unfortunately, the references do not disclose changes in charge generation mechanisms in a case where two types of phthalocyanines are included. The references also do not mention change of potential retention rate depending on the ratio of the contents of the two phthalocyanines in consideration of a charge generation mechanism.

Metal-free phthalocyanines are also studied in terms of various synthesis methods and purification methods, and are disclosed in Japanese Unexamined Patent Application Publication (KOKAI) Nos. H7-2071883 and S60-243089.

These references do not disclose or consider impurities from phthalocyanine derivatives. As a result, no study has been made about variation of charge generation mechanisms due to containment of impurities of phthalocyanine derivatives.

It is known that photoconductors include negative-charging laminated-layer-type photoconductors, positive-charging laminated-layer-type photoconductors, and positive-charging single-layer-type photoconductors.

Synthesis methods of phthalocyanine compound are disclosed in "Phthalocyanines" by C. C. Leznoff et al., 1989, VCH Publishers, Inc. and "The phthalocyanines" by F. H. Moser et al., 1983, CRC Press, for example. By-production of derivatives in the synthesis process of titanyloxophthalocyanine is disclosed in Japanese Unexamined Patent Application Publication No. H3-35245. A titanylphthalocyanine complex compound may be synthesized by the method disclosed in Japanese Unexamined Patent Application Publication No. H8-302223 or No. H9-230615.

The use of a phthalocyanine compound as a photosensitive material in a photoconductor is known. Methods of synthesis and use of these compound have been studied in some aspects. Unfortunately, a relationship between a charge generation mechanism and a potential retention rate has not been understood or clarified in mixed uses of two or more types of phthalocyanine compounds.

OBJECTS AND SUMMARY OF THE INVENTION

It is an object of the present invention to provide a photoconductor with excellent photoconductive characteristics.

It is another object of the present invention to provide, in particular, an excellent potential retention rates in a photoconductor.

It is another object of the invention to provide a method for manufacturing a photoconductor, the method comprising a step for forming a photosensitive layer with coating liquid and forming a photosensitive layer with an excellent potential retention rate.

Briefly stated, the present invention relates to an electrophotographic photoconductor and manufacturing method. The electrophotographic photoconductor includes a conductive substrate and a photosensitive layer formed on a substrate. The photosensitive layer includes at least a phthalocyanine compound as a charge generation substance. The photosensitive layer contains a first phthalocyanine compound as a main component and a second phthalocyanine compound as a secondary component and as a result, has greater ability to generate negative charges than the ability of the first phthalocyanine compound.

It is to be understood, that to solve the above-described problems, the inventors have made rigorous studies considering the negative-charge-generating ability of the phthalocyanine compound in the charge generation mechanism, and surprisingly found, as a result, that the potential retention rate of a photoconductor significantly increases when second phthalocyanine compound, having higher ability to generate negative charges than that of first phthalocyanine compound, is contained as a secondary component in the photosensitive layer including the first phthalocyanine compound as a charge generation substance.

It is to be further understood, that a potential retention rate of a photoconductor significantly increases when a phthalocyanine compound as a secondary component of charge generation substance is contained in addition to a phthalocyanine compound as a main component of charge generation substance in a coating liquid in the process of manufacturing the photoconductor, where the secondary phthalocyanine compound has higher ability to generate negative charges than an ability of the main phthalocyanine compound.

It is to be understood, that the photosensitive layer in a photoconductor of the invention may be either single layer type or laminated-layer type, and is not be limited to one of the two types. A coating liquid in a method of the invention for manufacturing a photoconductor may be applied to various coating methods including dip-coating and spray-coating, and is not limited to any specific coating method. It is to be understood, that 'mmol' represents 'milimole.'

According to an embodiment of the present invention, there is provided an electrophotographic photoconductor, comprising: a conductive substrate; a photosensitive layer on the conductive substrate; the photosensitive layer containing a first phthalocyanine compound as a main component of a charge generation substance and a second phthalocyanine compound as a secondary component of the charge generation substance; and the second phthalocyanine compound having a higher ability to generate negative charges than an ability of the first phthalocyanine compound.

According to another embodiment of the present invention, there is provided an electrophotographic photoconductor, wherein: at least one of a central element of the first phthalocyanine compound and a central element of the second phthalocyanine compound is titanium.

According to another embodiment of the present invention, there is provided an electrophotographic photoconductor, wherein: at least one of the first phthalocyanine compound and the second phthalocyanine compound is titanyloxophthalocyanine.

According to another embodiment of the present invention, there is provided an electrophotographic photoconductor, wherein: at least one of a central element of the first phthalocyanine compound and a central element of the second phthalocyanine compound is gallium.

According to another embodiment of the present invention, there is provided an electrophotographic photoconductor, wherein: at least one of a central element of the first phthalocyanine compound and a central element of the second phthalocyanine compound is indium.

According to another embodiment of the present invention, there is provided an electrophotographic photoconductor, wherein: at least one of a central element of the first phthalocyanine compound and a central element of the second phthalocyanine compound include hydrogen atoms.

According to another embodiment of the present invention, there is provided an electrophotographic photoconductor, wherein: at least one of the first phthalocyanine compound and the second phthalocyanine compound is 29H, 31 H-phthalocyanine.

According to another embodiment of the present invention, there is provided an electrophotographic photoconductor, wherein: at least one of the first phthalocyanine compound and the second phthalocyanine compound is X-type metal-free phthalocyanine.

According to another embodiment of the present invention, there is provided an electrophotographic photoconductor, wherein: at least one of the first phthalocyanine compound and the second phthalocyanine compound is X-type metal-free phthalocyanine.

According to another embodiment of the present invention, there is provided an electrophotographic photoconductor, wherein: the second phthalocyanine compound is in an amount of not more than about 600 mmol with respect to of 1 mol of the first phthalocyanine compound.

According to another embodiment of the present invention, there is provided an electrophotographic photoconductor, wherein: the second phthalocyanine compound is in an amount of not more than 600 mmol with respect to of 1 mol of the first phthalocyanine compound.

According to another embodiment of the present invention, there is provided an electrophotographic photoconductor, wherein: the second phthalocyanine compound is contained in an amount of not more than about 200 mmol with respect of 1 mol of the first phthalocyanine compound.

According to another embodiment of the present invention, there is provided a method for manufacturing an electrophotographic photoconductor comprising a step of: forming a photosensitive layer by coating a conductive substrate with a coating liquid including charge generation substance, wherein the coating liquid contains a first phthalocyanine compound as a main component and a second phthalocyanine compound as a secondary component, and the second phthalocyanine compound having a higher ability to generate negative charges than an ability of the first phthalocyanine compound.

According to another embodiment of the present invention, there is provide a method, wherein: an intensity ratio of the second phthalocyanine to the first phthalocyanine in an anion measurement is greater than the intensity ratio in cation measurement in a spectrum of the coating liquid observed by means of laser desorption ionization time-of-flight mass spectroscopy.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
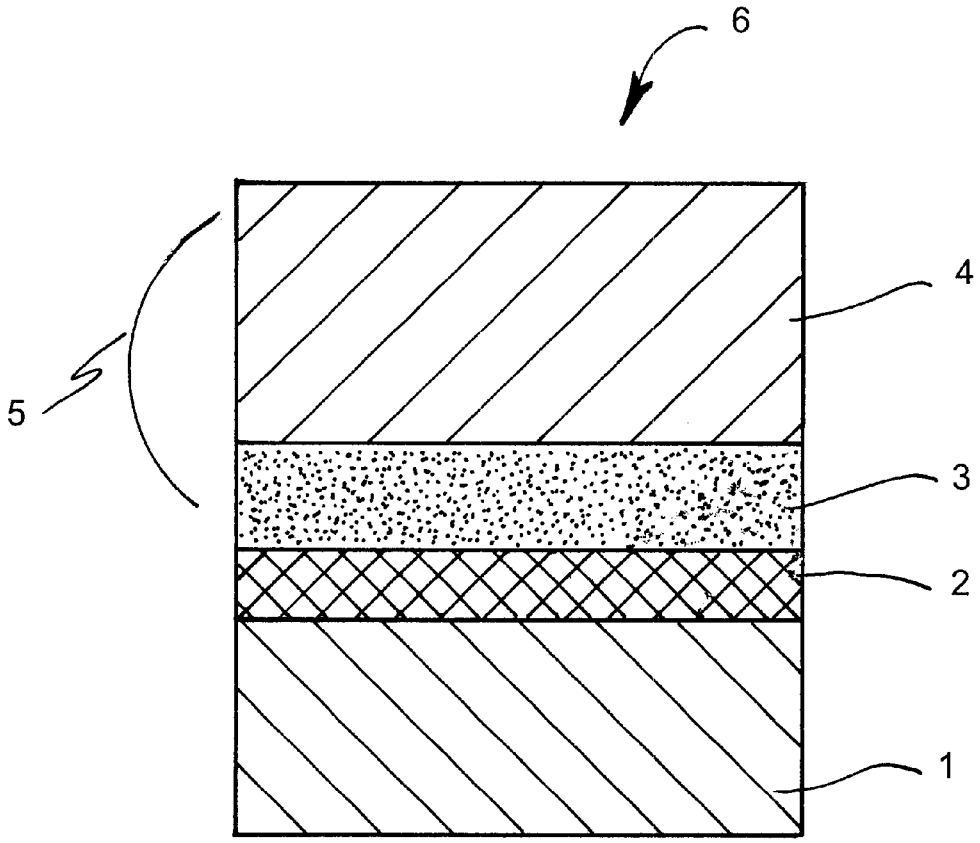
FIG. 1 is a schematic cross sectional view showing a photoconductor of an embodiment of the present invention.

Referring now to FIG. 1, a negative-charging laminated-layer photoconductor 6 includes a conductive substrate 1 and an undercoat layer 2 on substrate 1. A photosensitive layer 5 is laminated on undercoat layer 2.

Photosensitive layer 5 includes a charge generation layer 3 and a charge transport layer 4 laminated on charge generation layer 3.

It is to be understood, that photoconductor 6 is a function-separated type photoconductor comprising two separated functional layers, namely charge generation layer 3 and charge transport layer 4. Undercoat layer 2 may be alternatively provided in any types of photoconductor as described above. It is to be understood, that although not illustrated, a surface protective layer can be applied to photosensitive layer 5.

It is to be understood that, although the present invention will be described in detail, referring to photoconductor 6, material compositions and manufacturing methods for photoconductors, other than the materials and methods concerning the phthalocyanine compound described, may be appropriately selected from known materials and methods where appropriate.

Electrically conductive substrate 1 functions as an electrode for photoconductor 6, and also functions as a support for the other layers. Conductive substrate 1 may have a cylindrical shape, a planer shape, or a film shape, and may be formed of a metal or an alloy, such as aluminum, stainless steel, or nickel, glass, or resin treated to be given a certain conductivity.

The undercoat layer 2 may be formed of alcohol-soluble polyamide, solvent-soluble aromatic polyamide, or thermosetting urethane resin. The alcohol-soluble polyamide may be preferably a polymer or a copolymer including nylon 6, nylon 8, nylon 12, nylon 66, nylon 610, or nylon 612, or N-alkyl-modified- or N-alkoxyalkyl-modified-nylon. The specific material of these compounds may be AMILAN CM8000 (a 6/66/610/12 copolymerized nylon available from Toray Industries, Inc.), ELBAMIDE 9061 (a 6/66/612 copolymerized nylon available from Du Pont Japan Co., Ltd.), or DAIAMIDE T- 170 (a copolymerized nylon mainly composed of nylon 12, available from Daicel-Huels Co., Ltd.). Undercoat layer 2 may further include inorganic fine particles of, such as $TiO_2$, $SnO_2$, alumina, calcium carbonate, or silica, or various auxiliary agents giving conductivity as demanded by the manufacturer.

Charge generation layer 3, which generates charges upon receipt of light, is formed by depositing particles of a charge generating substance on undercoat layer 2 in a vacuum.

Charge generation layer 3 may also be formed by coating undercoat layer 2 with coating liquid containing a charge generating substance dispersed in a solvent with a resin binder. It is important for charge generation layer 3 to have a high ability of injecting the generated charges into the charge transport layer 4 as well as high efficiency of charge generation. It is to be understood, that it is desirable that charge generation layer 3 injects charges with less dependence on an electric field and has an excellent capability of charge injection even in a low electric field.

It is to be further understood as important for charge generation layer 3 to contain a first phthalocyanine compound and a second phthalocyanine compound. The first phthalocyanine compound being a main component for serving charge generation function in the charge generation layer. The second phthalocyanine compound being a secondary component that has higher ability to generate negative charges than the the first phthalocyanine compound.

The mechanism is not definite how the photoconductor with such a constitution significantly improves the potential retention rate. However, the following reasoning is suggested. Introducing irradiating light to a charge generation substance generates not only positive charges, namely holes, but actually also negative charges, namely electrons.

A mechanism for generating positive and negative charges may be considered to depend on the charge generation substance. The ability to generate positive and negative charges in the charge generation substance significantly affects photoconductive characteristics.

Photosensitive layer 5, in addition to containing the first phthalocyanine compound as a main component of a charge generation substance, includes the second phthalocyanine compound as a secondary component of the charge generation substance. The second phthalocyanine compound or secondary component, has a higher ability to generate negative charges than the first phthalocyanine compound.

Consequently, abilities of positive charge generation and negative charge generation can be intentionally balanced in charge generation layer 3. This consequence results in an improvement of positive charge generation ability for the main phthalocyanine compound, which leads to a desirable raise the potential retention rate of the photoconductor.

The phthalocyanine compounds used in the invention are not limited as long as the above conditions are satisfied and the known phthalocyanines appropriately used. At least one of the first and second phthalocyanine compounds may be preferably a phthalocyanine compound having a central element of titanium, more preferably, a titanyloxophthalocyanine.

Alternatively, preferable phthalocyanine compounds include a metal-free phthalocyanine having central elements of hydrogen atoms, in particular, 29H,31H-phthalocyanine, and X-type metal-free phthalocyanine.

A phthalocyanine compound having a central element of gallium or indium may also be preferably used. The second phthalocyanine compound having high ability of negative charge generation is preferably contained in an amount of not more than 600 mmol, more preferably not more than 200 mmol with respect to 1 mol of the first phthalocyanine compound.

In the charge generation mechanism for mixed phthalocyanine compounds, the difference between charge generation abilities for positive charges and for negative charges may be determined by measurement with laser desorption ionization time-of-flight mass spectrometry using laser light in near ultraviolet to visible light region as excitation light.

The light absorption band of a phthalocyanine compound may be separated into a Q band that corresponds to an absorption band in visible to near infrared region and a soret band that corresponds to ultraviolet region. This described in "The phthalocyanines" by F. H. Moser, et al., 1983, CRC Press, volume 1.

Actual electrophotographic photoconductors use a light source in the visible to near infrared region. Therefore, a photoconductor utilizing a phthalocyanine compound as charge generation substance performs charge generation using light absorption in principally Q band to form an electrophotographic image.

In laser desorption ionization time-of-flight mass spectrometry, utilizing laser light in near ultraviolet to visible region, a molecule in a sample is ionized to anion or cation by laser light. The ions are then separated based on the ratio of the mass to the charge of the ion to perform detection and analysis.

Known methods for ionizing the molecule of the sample in this analysis includes matrix-assisted laser desorption ionization and laser desorption ionization. These methods are described in detail in the collection of 'know-how' with Shimadzu/KRATOS time-of-flight mass spectrometer KOMPACT MALDI series. [hereinafter referred to as "know-how collection"]

In ionization by laser desorption, a component of a sample absorbs light with the irradiated wavelength and undergoes conversion to oscillation energy or optical excitation. This conversion results in ionization of the component. In this process, not only the positively charged component, but also the negatively charged component is generated corresponding to the positive charges depending on the wavelength of the irradiated light into the sample.

In ionization of a phthalocyanine compound by means of laser desorption, ionization, using a laser desorption ionization time-of-flight mass spectrometer, results in behavior of the phthalocyanine compound based on the light absorption. The "Compact Discovery" product, manufactured by Shimadzu Corporation, may be used for this process. Here, the Q band can be observed because the light source of this spectrometer is a nitrogen laser with wave length of 337 nm.

The Q band, as described earlier, is the light absorption band that involves electrophotographic image formation in the phthalocyanine compound of a photoconductor. Here, the light absorption in the soret band is extremely weak, and the absorption level may be ignored taking light absorption coefficient and other factors into account.

According to the disclosure of the "know-how collection", net time for ionization is less than several nsec using the above-mentioned spectrometer. The spectrometer allows measurement without breaking the phthalocyanine ring by adjusting the laser light to a suitable strength. Consequently, both qualitative and quantitative analysis easily be performed.

Figure 2:
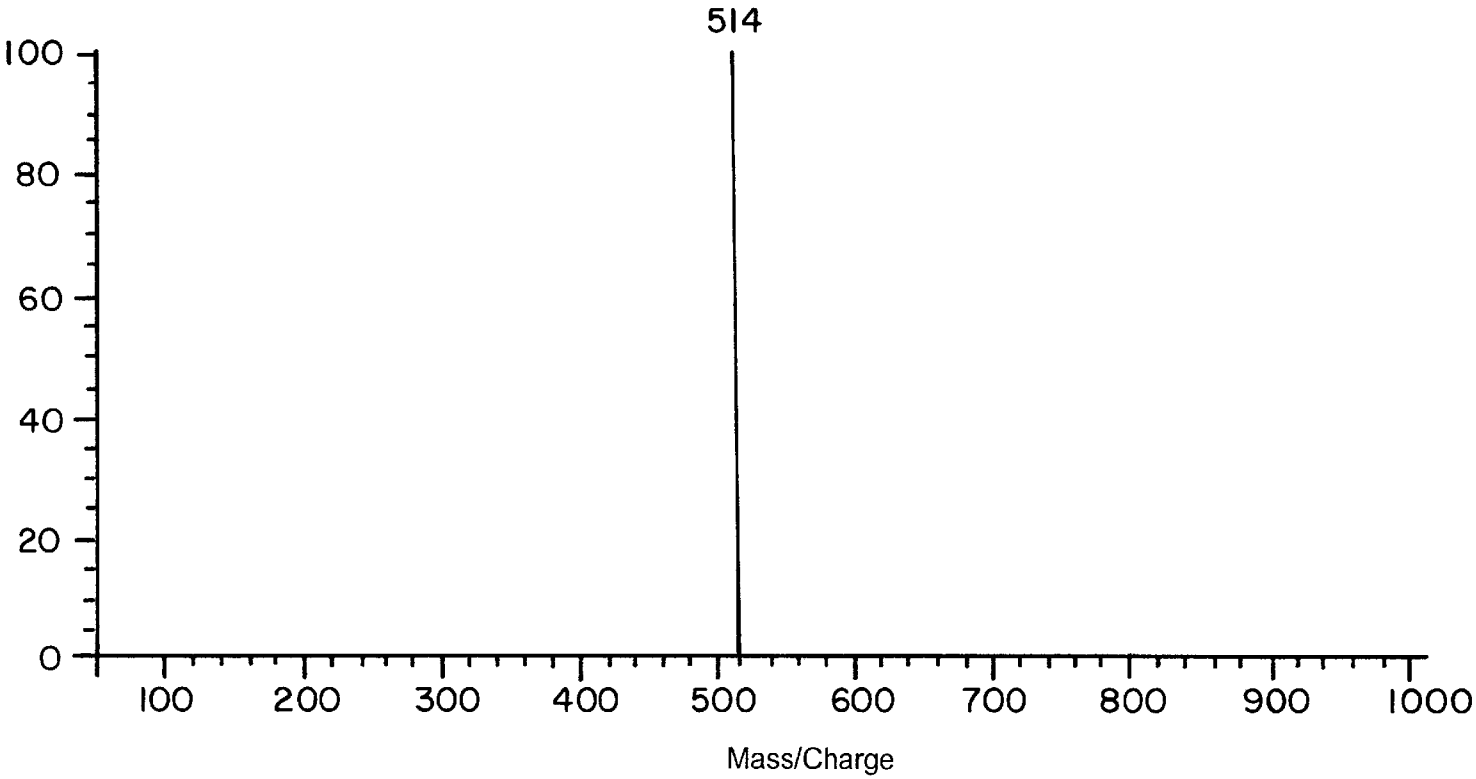
FIG. 2 is a spectrum of metal-free phthalocyanine observed by laser desorption ionization time-of-flight mass spectroscopy.
Figure 3:
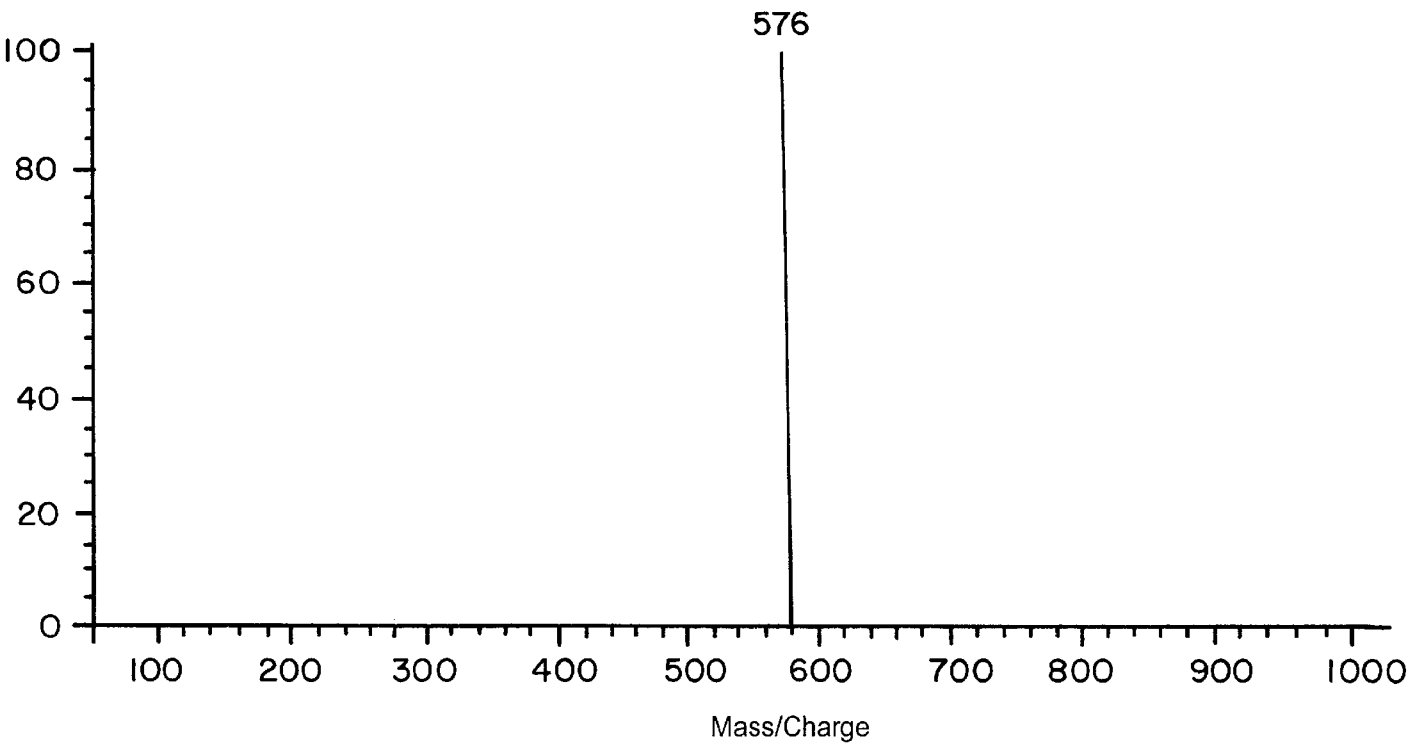
FIG. 3 is a spectrum of titanyloxophthalocyanine observed by laser desorption ionization time-of-flight mass spectroscopy.

The ion of the molecule of metal-free phthalocyanine or titanyloxophthalocyanine is detected easily. Referring now to FIG. 2, an example of a spectrum of a phthalocyanine compound observed for metal-free phthalocyanine. Referring now to FIG. 3, an example of a similar spectrum for titanyloxophthalocyanine is shown.

The method for detecting the generated ions in the laser desorption ionization time-of-flight mass spectrometry is a time-of-flight detection method. This detecting method performs mass spectrometry on the basis of the fact that the time of flight of the ion varies with the ratio of a mass M to a charge Z of a particular ion.

Using this detecting method, every generated ion may be lead to the detector as long as the ion does not decompose before reaching the detector. For example, the time for an ionized component with a mass number 1,000 to reach a detector is calculated to be 22 $\mu$sec using the spectrometer with a linear/LOW mode.

This time interval is in the same order as or shorter than the time interval in the process from generation of charges to formation of an electrophotographic image in an organic photoconductor, the latter time interval depending on the mobility of charges in the charge transport material and the size of the photoconductor drum, and being in the range of several tens of $\mu$sec to 0.2 sec. Polarity of the voltage that leads an ion to the detector may be also be exchanged, to enable both an anion and a cation to be measured in the same condition.

Detailed information on positive and negative charges generated in the phthalocyanine compound used as charge generation substances may be obtained by measurement on the phthalocyanine compound by means of laser desorption ionization time-of-flight mass spectrometry. This type of spectrometry employs laser desorption ionization with a light source in the near ultraviolet to visible light region.

The intensity of positive and negative ions obtained by this measurement allow observers evaluate relative charge generation ability for positive and negative charges in a photoconductor including a mixture of different phthalocyanine compounds.

A coating liquid for coating on conductive substrate 1 contains a first phthalocyanine compound as a main component and a second phthalocyanine compound as a secondary component.

It is to be understood, that a negative charge generation ability of the second phthalocyanine will be higher than an ability of the first phthalocyanine compound if the intensity ratio of the second phthalocyanine compound to the first phthalocyanine compound in the anion measurement is larger than the intensity ratio in the cation measurement.

It is to be understood, that one of the different phthalocyanine compounds may be a substantially pure substance obtained through sublimation. A phthalocyanine, that is a side product of a synthesis process for a main phthalocyanine and has high ability of negative charge generation, may be used as a secondary phthalocyanine together with the main phthalocyanine. The first and second phthalocyanine are contained in photosensitive layer 5 of photoconductor 6.

In addition to the above-described phthalocyanines, another pigment or dye selected from azo compounds, quinone compounds, indigo compounds, cyanine compounds, squarilium compounds and azurenium compounds, for example, may be used together with the phthalocyanines.

The resin binder used in charge generation layer 3 may be selected from polymers and copolymers of polycarbonate, polyester, polyamide, polyurethane, epoxy, poly(vinyl butyral), phenoxy, silicone, methacrylate, and halogenated compounds and cyanoethyl compounds of these substances, which may be used in suitable combination. The charge generating substance used in charge generation layer 3 is contained preferably in an amount of 10 to 5,000 parts by weight, more preferably 50 to 1,000 parts by weight with respect to 100 parts by weight of the resin binder.

The film thickness of charge generation layer 3 depends on the light absorption coefficient of the charge generation substance used and is preferably controlled to be not greater than 5 $\mu$m, and more preferably, not greater than 1 $\mu$m. Charge generation layer 3 contains the charge generation substance as a major component, to which charge transport substance and other material may be added.

Charge transport layer 4 is a coating film formed of material dispersing the charge transport substance in a resin binder. The charge transport substance may be selected from hydrazone compounds, styryl compounds, amine compounds, and their derivatives, used alone or in suitable combination.

Charge transport layer 4 serves as an insulating layer in the dark for retaining charges of photoconductor 6, and functions to transport charges injected from charge generation layer 3 upon receipt of light.

The binder resin used in charge transport layer 3 may be selected from polymers, mixed polymers, and copolymers of polycarbonate, polyester, polystyrene, and methacrylate, for example. It should be understood, that the resin binder is selected considering compatibility with the charge transport substance, as well as the mechanical, chemical and electrical stability and adhesiveness. The charge transport substance is contained preferably in an amount of 20 to 500 parts by weight, more preferably, 30 to 300 parts by weight with respect to 100 parts by weight of the resin binder.

The film thickness of charge transport layer 4 is preferably controlled in a range of 3 to 50 $\mu$m, more preferably 15 to 40 $\mu$m, so as to maintain a practically effective surface potential.

A method of the invention for manufacturing photoconductor 6 comprises a step of forming photosensitive layer 5 by coating conductive substrate 1 with a coating liquid containing the two phthalocyanine compounds that meet the above-described conditions and does not require other condition. Additional sub-steps may be included.

When photoconductor 6 is of a laminated-layer type, the method includes a step for forming charge generation layer 3 of photosensitive layer 5 using a coating liquid.

While the present invention is described with reference to specific examples of the embodiments of the invention in the followings, the invention shall not be limited to the examples.

EXAMPLE 1

Fabrication of an Undercoat Layer

A coating liquid for an undercoat layer was produced by mixing 70 parts by weight of a polyamide resin: AMILAN CM8000 available from Toray Industries, Inc. and 930 parts by weight of methanol. An aluminum substrate was coated with the coating liquid by dip-coating method, and dried to form an undercoat layer having a thickness of 0.5 $\mu$m.

Synthesis of Pure Titanyloxophthalocyanine

Initially, 800 g of o-phthalodinitrile (manufactured by Tokyo Chemical Industry Co., Ltd.) and 1.8 liter of quinoline (manufactured by Wako Pure Chemical Industries Co., Ltd.) were put into a reaction vessel and stirred. Subsequently, 297 g oftitanium tetrachloride (manufactured by Kishida Chemical Co., Ltd.) was dropped and stirred in a nitrogen atmosphere, then heated to 180® C. in 2 hr and stirred for 15 hr holding at this temperature.

The reacted liquid was allowed to cool to 130° C., and washed with 3 liter of N-methyl-2-pyrrolidinone (manufactured by Kanto Chemical Co., Ltd.). The resulted wet cake was heated and stirred in 1.8 liter of N-methyl-2-pyrrolidinone at 160° C. for 1 hr under a nitrogen atmosphere. The resulted mixture was allowed to cool down and filtered and then washed with 3 liter of N-methyl-2-pyrrolidinone, 2 liter of acetone, 2 liter of methanol, and 4 liter of warm water in this order, to obtain a wet cake.

The thus obtained wet cake of titanyloxophthalocyanine was heated and stirred at 80° C. for 1 hr in diluted hydrochloric acid consisting of 360 ml of 36% hydrochloric acid and 4 liter of water, allowed to cool down, filtered, and washed with 4 liter of warm water, and dried. The obtained article was purified three vacuum sublimation steps, and dried.

Subsequently, 200 g of the dry material was added to 4 kg of 96% sulfuric acid at −5° C. while being cooled and stirred so that the liquid temperature was kept at −5° C. or lower. The liquid was further stirred and cooled for 1 hr being held at −5° C. The resulting sulfuric acid solution was added to a mixture of 35 liter of water and 5 kg of ice, and stirred and cooled for 1 hr being held at 10° C. or lower. The liquid was filtered and washed with 10 liter of warm water.

The thus obtained material was mixed with diluted hydrochloric acid consisting of 10 liter of water and 770 ml of 36% hydrochloric acid, and heated and stirred at 80° C. for 1 hr. The liquid was allowed to cool, then filtered and washed with 10 liter of warm water, then dried to obtain titanyloxophthalocyanine.

The resulting substance was the purified by sublimation to obtain pure titanyloxophthalocyanine. An elemental analysis was conducted on the pure titanyloxophthalocyanine and chlorine was not detected. Additionally, mass spectroscopy did not detect any other phthalocyanine derivative.

Synthesis of a Phthalocyanine Compound Having the Same Central Element as in Titanyloxophthalocyanine.

Titanyloxophthalocyanine that accompanies chlorine-containing titanyloxophthalocyanine was obtained according to a method disclosed in Comparative Synthesis Example 1 in Japanese Unexamined Patent Application Publication (KOKAI) No. H3-35245.

Chlorine content, obtained by an elemental analysis, was 0.5%. Measurement with a laser desorption ionization time-or-flight mass spectrometer labeled "Kompact Discovery" and manufactured by Shimadzu Corporation confirmed titanyloxophthalocyanine with mass number M=576 and chlorine-containing titanyloxophthalocyanine with M=610.

The above cited reference, Japanese Unexamined Patent Application Publication (KOKAI) No. H3-35245, discloses that the substance with M=610 is chlorine-containing titanyloxophthalocyanine.

The resulting material was subjected to repeated sublimation purification, to obtain pure substance of chlorine-containing titanyloxophthalocyanine.

Fabrication of a Charge Generation Layer

One $\mu$mol, of the thus fabricated chlorine-containing titanyloxophthalocyanine compound, was added to 1 mol of titanyloxophthalocyanine. The resulting mixture, together with 0.5 liter of water and 1.5 liter of o-dichlorobenzene (manufactured by Kanto Chemical Co., Ltd.), were put into a ball mill including 6.6 kg of zirconia balls having diameter of 8 mm and subjected to milling for 24 hr. The resulted mixture was extracted with 1.5 liter of acetone and 1.5 liter of methanol, filtered, washed with 1.5 liter of water, and dried.

Ten parts by weight of the titanyloxophthalocyanine that includes chlorine-containing titanyloxophthalocyanine compound was mixed with 10 parts by weight of a vinyl chloride resin type MR-110 manufactured by Nippon Zeon Co., Ltd., 686 parts by weight of dichloromethan, and 294 parts by weight of 1,2-dichloroethane, and ultrasonically dispersed, to produce a coating liquid for the charge generation layer.

This coating liquid was coated on undercoat layer 2 by a dip coating method, to form a charge generation layer having a thickness of 0.2 $\mu$m after drying.

Fabrication of a Charge Transport Layer

A coating liquid for a charge transport layer was produced by mixing 100 parts by weight of 4-(diphenylamino)

benzaldehide phenyl (2-thienylmethyl) hydrazone (manufactured by Fuji Electric Co., Ltd.), 100 parts by weight of a polycarbonate resin (PANLITE K-1300 available from Teijin Chemical Co., Ltd.), 800 parts by weight of dichloromethane, 1 part by weight of a silane coupling agent (KP-340 available from Shin'etsu Chemical Co., Ltd.), and 4 parts by weight of bis (2,4-di-tert-butyl phenyl) phenylphosphonite (manufactured by Fuji Electric Co., Ltd.).

The substrate coated with the charge generation layer was coated with the coating liquid by dip-coating method and dried to form a charge transport layer having a thickness of 20 $\mu$m. Thus, photoconductor 6 of Example 1 was fabricated.

EXAMPLE 2

A photoconductor was fabricated in the same manner as in Example 1 except that the quantity of the chlorine-containing titanyloxophthalocyanine compound added to 1 mol of the titanyloxophthalocyanine was changed to 1 mmol(milimole).

EXAMPLE 3

A photoconductor was fabricated in the same manner as in Example 1 except that the quantity of the chlorine-containing titanyloxophthalocyanine compound added to 1 mol of the titanyloxophthalocyanine was changed to 200 mmol.

EXAMPLE 4

A photoconductor was fabricated in the same manner as in Example 1 except that the quantity of the chlorine-containing titanyloxophthalocyanine compound added to 1 mol of the titanyloxophthalocyanine was changed to 600 mmol.

EXAMPLE 5

A photoconductor was fabricated in the same manner as in Example 1 except that the chlorine-containing titanyloxophthalocyanine compound was replaced by the titanyltetrachlorophthalocyanine that was synthesized according to the Synthesis Example 1 in Japanese Unexamined Patent Application Publication (KOKAI) No. H3-94264.

EXAMPLE 6

A photoconductor was fabricated in the same manner as in Example 5 except that the quantity of the titanyltetrachlorophthalocyanine added to 1 mol of the titanyloxophthalocyanine was changed to 1 mmol.

EXAMPLE 7

A photoconductor was fabricated in the same manner as in Example 5 except that the quantity of the titanyltetrachlorophthalocyanine added to 1 mol of the titanyloxophthalocyanine was changed to 200 mmol.

EXAMPLE 8

A photoconductor was fabricated in the same manner as in Example 5 except that the quantity of the titanyltetrachlorophthalocyanine added to 1 mol of the titanyloxophthalocyanine was changed to 600 mmol.

Comparative Example 1

A photoconductor was fabricated in the same manner as in Example 1 except that the chlorine-containing titanyloxophthalocyanine was replaced by a X-type metal-free phthalocyanine: Fastgen Blue 8120B manufactured by Dainippon Ink and Chemicals, Inc.

Comparative Example 2

A photoconductor was fabricated in the same manner as in Comparative Example 1 except that the quantity of the X-type metal-free phthalocyanine added to 1 mol of the titanyloxophthalocyanine was changed to 1 mmol.

Comparative Example 3

A photoconductor was fabricated in the same manner as in Comparative Example 1 except that the quantity of the X-type metal-free phthalocyanine added to 1 mol of the titanyloxophthalocyanine was changed to 200 mmol.

Comparative Example 4

A photoconductor was fabricated in the same manner as in Comparative Example 1 except that the quantity of the X-type metal-free phthalocyanine added to 1 mol of the titanyloxophthalocyanine was changed to 600 mmol.

An electric characteristic of each photoconductor of Examples 1 to 8 and Comparative Examples 1 to 4 was measured with an electrostatic recording paper test apparatus: EPA-8200 manufactured by Kawaguchi Electric Works Co. Ltd. The photoconductor was charged in the dark to the surface potential of −600 V using a corotron and held in the dark for 5 seconds. A potential retention rate in this period was measured. The results are shown in Table 1.

TABLE 1

| | retention rate (%) | | retention rate (%) |
|---|---|---|---|
| Example 1 | 98.0 | Comp Example 1 | 92.0 |
| Example 2 | 97.6 | Comp Example 2 | 90.9 |
| Example 3 | 97.5 | Comp Example 3 | 91.7 |
| Example 4 | 97.2 | Comp Example 4 | 91.1 |
| Example 5 | 98.1 | | |
| Example 6 | 98.0 | | |
| Example 7 | 97.6 | | |
| Example 8 | 97.1 | | |

It is apparent from Table 1 that the potential retention rates of all Examples are high and favorable, while the potential retention rates of all Comparative Examples are lower in comparison with those of Examples.

For a coating liquid for the charge generation layer of each of the Examples and Comparative Examples, measurement was made using a laser desorption ionization time-of-flight mass spectrometer "Kompact Discovery" manufactured by Shimadzu Corporation employing laser desorption ionization method.

From the measurement, an intensity ratio of secondary component to the titanyloxophthalocyanine with M=576 was obtained for each of the cation measurement and the anion measurement. The measurement was made in linear/LOW mode. Integration was conducted as many times as possible for each of the Examples 1, 5, and Comparative Example 1, while integration was set to 50 times for any other Examples and Comparative Examples.

Laser light intensity was set to the value that was necessary and sufficient for observing ions of phthalocyanine compounds. The measurement allowed fair observation of ions of all the molecules of titanyloxophthalocyanine, chlorine-containing titanyloxophthalocyanine, titanyltetrachlorophthalocyanine, and X-type metal-free phthalocyanine.

The results of the measurements are shown in Table 2.

TABLE 2

| | intensity ratio in cation measurement (%) | intensity ratio in anion measurement (%) |
|---|---|---|
| Example 1 | not detected | detected a trace |
| Example 2 | not detected | 0.13 |
| Example 3 | 3.8 | 36.0 |
| Example 4 | 11.5 | 103.5 |
| Example 5 | not detected | detected a trace |
| Example 6 | not detected | 0.16 |
| Example 7 | 1.0 | 18.5 |
| Example 8 | 14.9 | 113.3 |
| Comp Example 1 | detected a trace | not detected |
| Comp Example 2 | 0.11 | not detected |
| Comp Example 3 | 29.3 | 9.6 |
| Comp Example 4 | 96.2 | 21.1 |

As apparent from Table 2, for the Examples, the observed intensity ratio of chlorine-containing titanyloxophthalocyanine to titanyloxophthalocyanine and the ratio of titanyltetrachlorophthalocyanine to titanyloxophthalocyanine are larger in the anion measurement than in the cation measurement. Therefore, chlorine-containing titanyloxophthalocyanine and titanyltetrachlorophthalocyanine have clearly higher ability to generate negative charges in comparison with titanyloxophthalocyanine.

In contrast, for the Comparative Examples, the observed intensity ratio of X-type metal-free phthalocyanine to titanyloxophthalocyanine is larger in the cation measurement than in the anion measurement. Therefore, X-type metal-free phthalocyanine has clearly lower ability to generate negative charges in comparison with titanyloxophthalocyanine.

EXAMPLE 9

A photoconductor was fabricated in the same manner as in Example 1 except that the titanyloxophthalocyanine was replaced by the 2,3-butandiol complex (hereinafter referred to as "diol complex") of the titanyloxophthalocyanine that was synthesized according to the Synthesis Example 1 in Japanese Unexamined Patent Application Publication (KOKAI) No. H5-273775.

EXAMPLE 10

A photoconductor was fabricated in the same manner as in Example 9 except that the quantity of the chlorine-containing titanyloxophthalocyanine added to 1 mol of the diol complex was changed to 1 mmol.

EXAMPLE 11

A photoconductor was fabricated in the same manner as in Example 9 except that the quantity of the chlorine-containing titanyloxophthalocyanine added to 1 mol of the diol complex was changed to 200 mmol.

EXAMPLE 12

A photoconductor was fabricated in the same manner as in Example 9 except that the quantity of the chlorine-containing titanyloxophthalocyanine added to 1 mol of the diol complex was changed to 600 mmol.

Comparative Example 5

A photoconductor was fabricated in the same manner as in Example 9 except that the chlorine-containing titanyloxophthalocyanine was replaced by the same X-type metal-free phthalocyanine as that used in Comparative Example 1.

Comparative Example 6

A photoconductor was fabricated in the same manner as in Comparative Example 5 except that the quantity of the X-type metal-free phthalocyanine added to 1 mol of the diol complex was changed to 1 mmol.

Comparative Example 7

A photoconductor was fabricated in the same manner as in Comparative Example 5 except that the quantity of the X-type metal-free phthalocyanine added to 1 mol of the diol complex was changed to 200 mmol.

Comparative Example 8

A photoconductor was fabricated in the same manner as in Comparative Example 5 except that the quantity of the X-type metal-free phthalocyanine added to 1 mol of the diol complex was changed to 600 mmol.

It should be understood, that an electric characteristic of each photoconductor of Examples 9 to 12 and Comparative Examples 5 to 8 was measured with an electrostatic recording paper test apparatus: EPA-8200 manufactured by Kawaguchi Electric Works Co. Ltd.

The photoconductor was charged in the dark to the surface potential of −600 V using a corotron and held in the dark for 5 seconds. A potential retention rate in this period was measured. The results are shown in Table 3.

TABLE 3

| | retention rate (%) | | retention rate (%) |
|---|---|---|---|
| Example 9 | 97.6 | Comp Example 5 | 90.3 |
| Example 10 | 96.8 | Comp Example 6 | 90.9 |
| Example 11 | 97.0 | Comp Example 7 | 90.0 |
| Example 12 | 96.9 | Comp Example 8 | 90.2 |

It is apparent from Table 3, that the potential retention rates of all Examples are high and favorable, while the potential retention rates of all Comparative Examples are lower in comparison with those of Examples.

For a coating liquid for the charge generation layer of each of the Examples and Comparative Examples, measurement was made using a laser desorption ionization time-of-flight mass spectrometer "Kompact Discovery" manufactured by Shimadzu Corporation employing laser desorption ionization method.

From the measurement, a ratio of intensity of ions with mass number originated from secondary component to total of intensity of peaks of ions with mass number originated from diol complex was obtained for each of the cation measurement and the anion measurement. The measurement was made in linear/LOW mode. Integration was conducted as many times as possible for each of the Example 9 and Comparative Example 5, while integration was set to 50 times for any other Examples and Comparative Examples.

Laser light intensity was set to the value that was necessary and sufficient for observing ions of phthalocyanine compounds. The measurement allowed fair observation of ions of all the molecules of diol complex, chlorine-containing titanyloxophthalocyanine, and X-type metal-free phthalocyanine.

The results of the measurements are shown in Table 4.

TABLE 4

| | intensity ratio in cation measurement (%) | intensity ratio in anion measurement (%) |
|---|---|---|
| Example 9 | not detected | detected a trace |
| Example 10 | not detected | 0.18 |
| Example 11 | 3.1 | 35.2 |
| Example 12 | 11.8 | 102.5 |
| Comp Example 5 | detected a trace | not detected |
| Comp Example 6 | 0.1 | not detected |
| Comp Example 7 | 25.9 | 14.2 |
| Comp Example 8 | 74.6 | 39.1 |

As apparent from Table 4, for the above Examples, the observed intensity ratio of chlorine-containing titanyloxophthalocyanine to diol complex is larger in the anion measurement than in the cation measurement. Therefore, it is to be understood that chlorine-containing titanyloxophthalocyanine has clearly higher ability to generate negative charges in comparison with diol complex.

In contrast, for the Comparative Examples, the observed intensity ratio of X-type metal-free phthalocyanine to diol complex is larger in the cation measurement than in the anion measurement. Therefore, X-type metal-free phthalocyanine has clearly lower ability to generate negative charges in comparison with diol complex.

EXAMPLE 13

A photoconductor was fabricated in the same manner as in Example 1 except that the titanyloxophthalocyanine was replaced by chlorogallium phthalocyanine synthesized by a common method and the chlorine-containing titanyloxophthalocyanine was replaced by the titanyloxophthalocyanine synthesized according to the method in Example 1.

EXAMPLE 14

A photoconductor was fabricated in the same manner as in Example 13 except that the quantity of the titanyloxophthalocyanine added to 1 mol of the chlorogallium phthalocyanine was changed to 1 mmol.

EXAMPLE 15

A photoconductor was fabricated in the same manner as in Example 13 except that the quantity of the titanyloxophthalocyanine added to 1 mol of the chlorogallium phthalocyanine was changed to 200 mmol.

EXAMPLE 16

A photoconductor was fabricated in the same manner as in Example 13 except that the quantity of the titanyloxophthalocyanine added to 1 mol of the chlorogallium phthalocyanine was changed to 600 mmol.

Comparative Example 9

A photoconductor was fabricated in the same manner as in Example 13 except that the titanyloxophthalocyanine was replaced by the same X-type metal-free phthalocyanine as that used in Comparative Example 1.

COMPARATIVE EXAMPLE 10

A photoconductor was fabricated in the same manner as in Comparative Example 9 except that the quantity of the X-type metal-free phthalocyanine added to 1 mol of the chlorogallium phthalocyanine was changed to 1 mmol.

Comparative Example 11

A photoconductor was fabricated in the same manner as in Comparative Example 9 except that the quantity of the X-type metal-free phthalocyanine added to 1 mol of the chlorogallium phthalocyanine was changed to 200 mmol.

Comparative Example 12

A photoconductor was fabricated in the same manner as in Comparative Example 9 except that the quantity of the X-type metal-free phthalocyanine added to 1 mol of the chlorogallium phthalocyanine was changed to 600 mmol.

An electric characteristic of each photoconductor of Examples 13 to 16 and Comparative Examples 9 to 12 was measured with an electrostatic recording paper test apparatus: EPA-8200 manufactured by Kawaguchi Electric Works Co. Ltd. The photoconductor was charged in the dark to the surface potential of −600 V using a corotron and held in the dark for 5 seconds.

A potential retention rate in this period was measured. The results are shown in Table 5.

TABLE 5

| | retention rate (%) | | retention rate (%) |
|---|---|---|---|
| Example 13 | 97.0 | Comp Example 9 | 90.5 |
| Example 14 | 96.6 | Comp Example 10 | 91.1 |
| Example 15 | 97.3 | Comp Example 11 | 90.8 |
| Example 16 | 96.9 | Comp Example 12 | 90.4 |

It is apparent from Table 5 that the potential retention rates of all Examples are high and favorable, while the potential retention rates of all Comparative Examples are lower in comparison with those of Examples.

For a coating liquid for the charge generation layer of each of the Examples and Comparative Examples, measurement was made using a laser desorption ionization time-of-flight mass spectrometer "Kompact Discovery" manufactured by Shimadzu Corporation employing laser desorption ionization method.

From the measurement, a ratio of intensity of ions with mass number originated from secondary component to total of intensity of peaks of ions with mass number originated from chlorogallium phthalocyanine was obtained for each of the cation measurement and the anion measurement. The measurement was made in linear/LOW mode. Integration was conducted as many times as possible for each of the Example 13 and Comparative Example 9, while integration was set to 50 times for any other Examples and Comparative Examples.

Laser light intensity was set to the value that was necessary and sufficient for observing ions of phthalocyanine compounds. The measurement allowed fair observation of ions of all the molecules of chlorogallium phthalocyanine, titanyloxophthalocyanine, and X-type metal-free phthalocyanine.

The results of the measurements are shown in Table 6.

TABLE 6

| | intensity ratio in cation measurement (%) | intensity ratio in anion measurement (%) |
|---|---|---|
| Example 13 | not detected | detected a trace |
| Example 14 | 0.02 | 0.11 |
| Example 15 | 15.1 | 23.7 |
| Example 16 | 50.4 | 68.6 |
| Comp Example 9 | detected a trace | not detected |
| Comp Example 10 | 0.13 | 0.03 |
| Comp Example 11 | 25.1 | 13.8 |
| Comp Example 12 | 77.2 | 41.1 |

As apparent from Table 6, for the Examples, the observed intensity ratio oftitanyloxophthalocyanine to chlorogallium phthalocyanine is larger in the anion measurement than in the cation measurement. Therefore, titanyloxophthalocyanine has clearly higher ability to generate negative charges in comparison with chlorogallium phthalocyanine.

In contrast, for the Comparative Examples, the observed intensity ratio of X-type metal-free phthalocyanine to chlorogallium phthalocyanine is larger in the cation measurement than in the anion measurement. Therefore, X-type metal-free phthalocyanine has clearly lower ability to generate negative charges in comparison with chlorogallium phthalocyanine.

EXAMPLE 17

A photoconductor was fabricated in the same manner as in Example 13 except that the chlorogallium phthalocyanine was replaced by chloroindium phthalocyanine synthesized by a common method.

EXAMPLE 18

A photoconductor was fabricated in the same manner as in Example 17 except that the quantity of the titanyloxophthalocyanine added to 1 mol of the chloroindium phthalocyanine was changed to 1 mmol.

EXAMPLE 19

A photoconductor was fabricated in the same manner as in Example 17 except that the quantity of the titanyloxophthalocyanine added to 1 mol of the chloroindium phthalocyanine was changed to 200 mmol.

EXAMPLE 20

A photoconductor was fabricated in the same manner as in Example 17 except that the quantity of the titanyloxophthalocyanine added to 1 mol of the chloroindium phthalocyanine was changed to 600 mmol.

Comparative Example 13

A photoconductor was fabricated in the same manner as in Example 17 except that the titanyloxophthalocyanine was replaced by the same X-type metal-free phthalocyanine as that used in Comparative Example 1.

Comparative Example 14

A photoconductor was fabricated in the same manner as in Comparative Example 13 except that the quantity of the X-type metal-free phthalocyanine added to 1 mol of the chloroindium phthalocyanine was changed to 1 mmol.

Comparative Example 15

A photoconductor was fabricated in the same manner as in Comparative Example 13 except that the quantity of the X-type metal-free phthalocyanine added to 1 mol of the chloroindium phthalocyanine was changed to 200 mmol.

Comparative Example 16

A photoconductor was fabricated in the same manner as in Comparative Example 13 except that the quantity of the X-type metal-free phthalocyanine added to 1 mol of the chloroindium phthalocyanine was changed to 600 mmol.

An electric characteristic of each photoconductor of Examples 17 to 20 and Comparative Examples 13 to 16 was measured with an electrostatic recording paper test apparatus: EPA-8200 manufactured by Kawaguchi Electric Works Co. Ltd. The photoconductor was charged in the dark to the surface potential of −600 V using a corotron and held in the dark for 5 seconds. A potential retention rate in this period was measured. The results are shown in Table 7.

TABLE 7

| | retention rate (%) | | retention rate (%) |
|---|---|---|---|
| Example 17 | 96.7 | Comp Example 13 | 90.8 |
| Example 18 | 97.3 | Comp Example 14 | 91.1 |
| Example 19 | 97.1 | Comp Example 15 | 90.2 |
| Example 20 | 97.0 | Comp Example 16 | 90.7 |

It is apparent from Table 7 that the potential retention rates of all Examples are high and favorable, while the potential retention rates of all Comparative Examples are lower in comparison with those of Examples.

For a coating liquid for the charge generation layer of each of the Examples and Comparative Examples, measurement was made using a laser desorption ionization time-of-flight mass spectrometer "Kompact Discovery" manufactured by Shimadzu Corporation employing laser desorption ionization method.

From the measurement, a ratio of intensity of ions with mass number originated from secondary component to total of intensity of peaks of ions with mass number originated from chloroindium phthalocyanine was obtained for each of the cation measurement and the anion measurement. The measurement was made in linear/LOW mode. Integration was conducted as many times as possible for each of the Example 17 and Comparative Example 13, while integration was set to 50 times for any other Examples and Comparative Examples.

Laser light intensity was set to the value that was necessary and sufficient for observing ions of phthalocyanine compounds. The measurement allowed fair observation of ions of all the molecules of chloroindium phthalocyanine, titanyloxophthalocyanine, and X-type metal-free phthalocyanine.

The results of the measurements are shown in Table 8.

TABLE 8

| | intensity ratio in cation measurement (%) | intensity ratio in anion measurement (%) |
|---|---|---|
| Example 17 | not detected | detected a trace |
| Example 18 | 0.02 | 0.10 |
| Example 19 | 13.8 | 25.9 |
| Example 20 | 48.2 | 70.1 |
| Comp Example 13 | detected a trace | not detected |
| Comp Example 14 | 0.13 | 0.01 |

TABLE 8-continued

| | intensity ratio in cation measurement (%) | intensity ratio in anion measurement (%) |
|---|---|---|
| Comp Example 15 | 26.6 | 12.9 |
| Comp Example 16 | 80.8 | 38.7 |

As apparent from Table 8, for the Examples, the observed intensity ratio of titanyloxophthalocyanine to chloroindium phthalocyanine is larger in the anion measurement than in the cation measurement. Therefore, titanyloxophthalocyanine has clearly higher ability to generate negative charges in comparison with chloroindium phthalocyanine.

In contrast, for the Comparative Examples, the observed intensity ratio of X-type metal-free phthalocyanine to chloroindium phthalocyanine is larger in the cation measurement than in the anion measurement. Therefore, X-type metal-free phthalocyanine has clearly lower ability to generate negative charges in comparison with chloroindium phthalocyanine.

EXAMPLE 21

After forming an undercoat layer in the same manner as in Example 1, a charge generation layer was formed by the following procedure.

Initially, an X-type metal-free phthalocyanine was synthesized according to the method disclosed in Example 1 in Japanese Unexamined Patent Application Publication (KOKAI) No. H7-207183. The obtained substance was purified by sublimation. Then, TOF-MS measurement with a laser desorption ionization was conducted using "Kompact Dicsovery" manufactured by Shimadzu Corporation. It was confirmed, that any ion except the ion of metal-free phthalocyanine molecule with M=514 was not detected.

To 1 mol of the X-type metal-free phthalocyanine, 1 $\mu$mol of titanyloxophthalocyanine synthesized in Example 1 was added. Then, the crystal form of the obtained substance was transformed to FX-type according to the method disclosed in Example 2 in the above-cited reference: KOKAI No. H7-207183. Thus, FX-type metal-free phthalocyanine containing titanyloxophthalocyanine was obtained.

Ten parts by weight of the FX-type metal-free phthalocyanine containing titanyloxophthalocyanine, 10 parts by weight of vinyl chloride resin: MR-110 manufactured by Nippon Zeon Co. Ltd., 686 parts by weight of dichloromethane, and 294 parts by weight of 1,2-dichloroethane were mixed and ultrasonically dispersed to obtain coating liquid for a charge generation layer.

The coating liquid for a charge generation layer was coated on the undercoat layer by dip-coating method to form a charge generation layer having dried thickness of 0.2 $\mu$m. A charge transport layer was formed on the charge generation layer in the same manner as in Example 1, to fabricate a photoconductor.

EXAMPLE 22

A photoconductor was fabricated in the same manner as in Example 21 except that the quantity of the titanyloxophthalocyanine added to 1 mol of the metal-free phthalocyanine was changed to 1 mmol.

EXAMPLE 23

A photoconductor was fabricated in the same manner as in Example 21 except that the quantity of the titanyloxophthalocyanine added to 1 mol of the metal-free phthalocyanine was changed to 200 mmol.

EXAMPLE 24

A photoconductor was fabricated in the same manner as in Example 21 except that the quantity of the titanyloxophthalocyanine added to 1 mol of the metal-free phthalocyanine was changed to 600 mmol.

Comparative Example 17

A photoconductor was fabricated in the same manner as in Example 21 except that the titanyloxophthalocyanine was replaced by 2,9,16,23-tetra-tert-butyl-29H,31H-phthalocyanine (hereinafter shortened to "butyl metal-free phthalocyanine"). The butyl metal-free phthalocyanine was used after purifying a reagent manufactured by Sigma-Aldrich, Inc. by means of the recrystallization method.

Comparative Example 18

A photoconductor was fabricated in the same manner as in Comparative Example 17 except that the quantity of the butyl metal-free phthalocyanine added to 1 mol of the metal-free phthalocyanine was changed to 1 mmol.

Comparative Example 19

A photoconductor was fabricated in the same manner as in Comparative Example 17 except that the quantity of the butyl metal-free phthalocyanine added to 1 mol of the metal-free phthalocyanine was changed to 200 mmol.

Comparative Example 20

A photoconductor was fabricated in the same manner as in Comparative Example 17 except that the quantity of the butyl metal-free phthalocyanine added to 1 mol of the metal-free phthalocyanine was changed to 600 mmol.

An electric characteristic of each photoconductor of Examples 21 to 24 and Comparative Examples 17 to 20 was measured with an electrostatic recording paper test apparatus: EPA-8200 manufactured by Kawaguchi Electric Works Co. Ltd. The photoconductor was charged in the dark to the surface potential of −600 V using a corotron and held in the dark for 5 seconds. A potential retention rate in this period was measured. The results are shown in Table 9.

TABLE 9

| | retention rate (%) | | retention rate (%) |
|---|---|---|---|
| Example 21 | 97.1 | Comp Example 17 | 91.4 |
| Example 22 | 96.8 | Comp Example 18 | 91.5 |
| Example 23 | 96.8 | Comp Example 19 | 91.7 |
| Example 24 | 96.5 | Comp Example 20 | 91.0 |

It is apparent from Table 9 that the potential retention rates of all Examples are high and favorable, while the potential retention rates of all Comparative Examples are lower in comparison with those of Examples.

For a coating liquid for the charge generation layer of each of the Examples and Comparative Examples, measurement was made using a laser desorption ionization time-of-flight mass spectrometer "Kompact Discovery" manufactured by Shimadzu Corporation employing laser desorption ionization method.

From the measurement, a ratio of intensity of ions with mass number originated from secondary component to total of intensity of peaks of ions with mass number M=514 originated from metal-free phthalocyanine was obtained for each of the cation measurement and the anion measurement. The measurement was made in linear/LOW mode.

Integration was conducted as many times as possible for each of the Example 21 and Comparative Example 17, while integration was set to 50 times for any other Examples and Comparative Examples. Laser light intensity was set to the value that was necessary and sufficient for observing ions of phthalocyanine compounds. The measurement allowed fair observation of ions of both of the molecules of FX-type transformed metal-free phthalocyanine and titanyloxophthalocyanine. With regard to butyl metal-free phthalocyanine, all of the intensity of fragment peaks containing a phthalocyanine ring was summed, because fragments in which an alkyl group was eliminated were also observed.

The results of the measurements are shown in Table 10.

TABLE 10

| | intensity ratio in cation measurement (%) | intensity ratio in anion measurement (%) |
|---|---|---|
| Example 21 | not detected | detected a trace |
| Example 22 | not detected | 0.11 |
| Example 23 | 3.2 | 31.7 |
| Example 24 | 10.9 | 100.2 |
| Comp Example 17 | detected a trace | not detected |
| Comp Example 18 | 0.10 | not detected |
| Comp Example 19 | 30.3 | 9.6 |
| Comp Example 20 | 98.2 | 21.1 |

As apparent from Table 10, for the Examples, the observed intensity ratio of titanyloxophthalocyanine to FX-type transformed metal-free phthalocyanine is larger in the anion measurement than in the cation measurement. Therefore, titanyloxophthalocyanine has clearly higher ability to generate negative charges in comparison with FX-type transformed metal-free phthalocyanine.

In contrast, for the Comparative Examples, the observed intensity ratio of butyl metal-free phthalocyanine to FX-type transformed metal-free phthalocyanine is larger in the cation measurement than in the anion measurement. Therefore, butyl metal-free phthalocyanine has clearly lower ability to generate negative charges in comparison with FX-type transformed metal-free phthalocyanine.

EXAMPLE 25

A photoconductor was fabricated in the same manner as in Example 21 except that after adding titanyloxophthalocyanine to X-type metal-free phthalocyanine, by transforming the crystal form to X-type according to the disclosure in Comparative Example 4 in Japanese Unexamined Patent Application Publication (KOKAI) No. H7-207183, X-type metal-free phthalocyanine containing titanyloxophthalocyanine was obtained and used for the coating liquid of the charge generation layer.

EXAMPLE 26

A photoconductor was fabricated in the same manner as in Example 25 except that the quantity of the titanyloxophthalocyanine added to 1 mol of the metal-free phthalocyanine was changed to 1 mmol.

EXAMPLE 27

A photoconductor was fabricated in the same manner as in Example 25 except that the quantity of the titanyloxophthalocyanine added to 1 mol of the metal-free phthalocyanine was changed to 200 mmol.

EXAMPLE 28

A photoconductor was fabricated in the same manner as in Example 25 except that the quantity of the titanyloxophthalocyanine added to 1 mol of the metal-free phthalocyanine was changed to 600 mmol.

Comparative Example 21

A photoconductor was fabricated in the same manner as in Example 25 except that the titanyloxophthalocyanine was replaced by butyl metal-free phthalocyanine. The butyl metal-free phthalocyanine used in Comparative Example 21 was the same as that used in Comparative Example 17.

Comparative Example 22

A photoconductor was fabricated in the same manner as in Comparative Example 25 except that the quantity of the butyl metal-free phthalocyanine added to 1 mol of the metal-free phthalocyanine was changed to 1 mmol.

Comparative Example 23

A photoconductor was fabricated in the same manner as in Comparative Example 25 except that the quantity of the butyl metal-free phthalocyanine added to 1 mol of the metal-free phthalocyanine was changed to 200 mmol.

Comparative Example 24

A photoconductor was fabricated in the same manner as in Comparative Example 25 except that the quantity of the butyl metal-free phthalocyanine added to 1 mol of the metal-free phthalocyanine was changed to 600 mmol.

An electric characteristic of each photoconductor of Examples 25 to 28 and Comparative Examples 21 to 24 was measured with an electrostatic recording paper test apparatus: EPA-8200 manufactured by Kawaguchi Electric Works Co. Ltd. The photoconductor was charged in the dark to the surface potential of −600 V using a corotron and held in the dark for 5 seconds. A potential retention rate in this period was measured. The results are shown in Table 11.

TABLE 11

| | retention rate (%) | | retention rate (%) |
|---|---|---|---|
| Example 25 | 96.9 | Comp Example 21 | 91.3 |
| Example 26 | 96.7 | Comp Example 22 | 90.8 |
| Example 27 | 96.3 | Comp Example 23 | 90.2 |
| Example 28 | 96.2 | Comp Example 24 | 90.1 |

It is apparent from Table 11 that the potential retention rates of all Examples are high and favorable, while the potential retention rates of all Comparative Examples are lower in comparison with those of Examples.

For a coating liquid for the charge generation layer of each of the Examples and Comparative Examples, measurement was made using a laser desorption ionization time-of-flight mass spectrometer "Kompact Discovery" manufactured by Shimadzu Corporation employing laser desorption ionization method.

From the measurement, a ratio of intensity of ions with mass number originated from secondary component to total of intensity of peaks of ions with mass number M=514 originated from metal-free phthalocyanine was obtained for each of the cation measurement and the anion measurement. The measurement was made in linear/LOW mode.

Integration was conducted as many times as possible for each of the Example 25 and Comparative Example 21, while integration was set to 50 times for any other Examples and Comparative Examples. Laser light intensity was set to the value that was necessary and sufficient for observing ions of phthalocyanine compounds. The measurement allowed fair observation of ions of both of the molecules of X-type transformed metal-free phthalocyanine and titanyloxophthalocyanine. With regard to butyl metal-free phthalocyanine, all of the intensity of fragment peaks containing a phthalocyanine ring was summed, because fragments in which an alkyl group was eliminated were also observed.

The results of the measurements are shown in Table 12.

TABLE 12

| | intensity ratio in cation measurement (%) | intensity ratio in anion measurement (%) |
|---|---|---|
| Example 25 | not detected | detected a trace |
| Example 26 | not detected | 0.10 |
| Example 27 | 3.0 | 30.9 |
| Example 28 | 11.4 | 98.3 |
| Comp Example 21 | detected a trace | not detected |
| Comp Example 22 | 0.12 | not detected |
| Comp Example 23 | 31.5 | 8.2 |
| Comp Example 24 | 101.3 | 18.1 |

As apparent from Table 12, for the Examples, the observed intensity ratio of titanyloxophthalocyanine to X-type transformed metal-free phthalocyanine is larger in the anion measurement than in the cation measurement. Therefore, titanyloxophthalocyanine has clearly higher ability to generate negative charges in comparison with X-type transformed metal-free phthalocyanine.

In contrast, for the Comparative Examples, the observed intensity ratio of butyl metal-free phthalocyanine to X-type transformed metal-free phthalocyanine is larger in the cation measurement than in the anion measurement. Therefore, butyl metal-free phthalocyanine has clearly lower ability to generate negative charges in comparison with X-type transformed metal-free phthalocyanine.

As is described, photoconductor 6 exhibiting anexcellent potential retention rate, is provided. A method for the creation of photoconductor 6 is also provide above.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic photoconductor comprising:

a conductive substrate;

a photosensitive layer on said conductive substrate;

said photosensitive layer containing a first phthalocyanine compound as a main component of a charge generation substance and a second phthalocyanine compound as a secondary component of said charge generation substance;

a central element of said first phthalocyanine compound is titanium; and said second phthalocyanine compound having a higher ability to generate negative charges than an ability of said first phthalocyanine compound.

2. An electrophotographic photoconductor according to claim 1, wherein:

at least one of said first phthalocyanine compound and said second phthalocyanine compound is titanyloxophtalocyanine.

3. An electrophotographic photoconductor according to claim 1, wherein:

said second phthalocyanine compound is in an amount of not more than about 600 mmol with respect to of 1 mol of said first phthalocyanine compound.

4. An electrophotographic photoconductor according to claim 1, wherein:

said second phthalocyanine compound is in an amount of not more than 600 mmol with respect to of 1 mol of said first phthalocyanine compound.

5. An electrophotographic photoconductor according to claim 3, wherein:

said second phthalocyanine compound is contained in an amount of not more than about 200 mmol with respect of 1 mol of said first phthalocyanine compound.

6. A method for manufacturing an electrophotographic photoconductor comprising a step of:

forming a photosensitive layer by coating a conductive substrate with a coating liquid including charge generation substance, wherein said coating liquid contains a first phthalocyanine compound as a main component and a second phthalocyanine compound as a secondary component, and a central element of said first phthalocyanine compound is titanium, and said second phthalocyanine compound having a higher ability to generate negative charges than an ability of said first phthalocyanine compound.

7. A method, according to claim 6, wherein:

an intensity ratio of said second phthalocyanine to said first phthalocyanine in an anion measurement is greater than said intensity ratio in a cation measurement in a spectrum of said coating liquid observed by means of laser desorption ionization time-of-flight mass spectroscopy.

8. An electrophotographic photoconductor according to claim 1, wherein:

said second phthalocyanine compound is chlorine-containing titanyloxophthalocyanine.

* * * * *